United States Patent [19]

Seyler

[11] 4,247,102

[45] Jan. 27, 1981

[54] BOWLING BALL INCLUDING REMOVABLE FINGER GRIP INSERT

[76] Inventor: Robert Seyler, 28, Brown St., West Babylon, Long Island, N.Y. 11704

[21] Appl. No.: 73,504

[22] Filed: Sep. 7, 1979

[51] Int. Cl.[3] ..... A63B 37/00; A63B 43/04

[52] U.S. Cl. ..... 273/63 B

[58] Field of Search ..... 273/63 R, 63 A, 63 B, 273/63 D, 63 E, 63 F, 64; 33/174 F

[56] References Cited

U.S. PATENT DOCUMENTS

| | | | |
|---|---|---|---|
| 533,011 | 1/1895 | Huntoon | 273/63 B |
| 2,210,528 | 8/1940 | Darby | 273/63 B |
| 2,436,976 | 3/1948 | Seurynck | 273/63 B |
| 2,844,375 | 7/1958 | Nestor | 273/63 B |
| 3,039,774 | 6/1962 | Gerlach | 273/63 B |
| 3,129,002 | 4/1964 | Bednash | 273/63 B |

*Primary Examiner*—George J. Marlo
*Attorney, Agent, or Firm*—Browdy and Neimark

[57] ABSTRACT

A removable interchangeable thumb or finger grip insert for the thumb or finger hole of a bowling ball. The insert is generally cylindrical and hollow and is formed with a slotted resilient hollow bottom axial internally and externally threaded stud for threadedly engaging in the bottom of the bowling ball hole. A tapered adjustable wedging screw is engaged in the hollow stud for expanding it to tightly grip the bowling ball. The screw has a square bore engageable by a correspondingly-shaped L-shaped square tool bar. A spanner wrench tool is provided, the bottom of the wrench tool having a pair of spaced depending pins engageable in holes provided in the bottom of the insert for rotating same.

10 Claims, 8 Drawing Figures

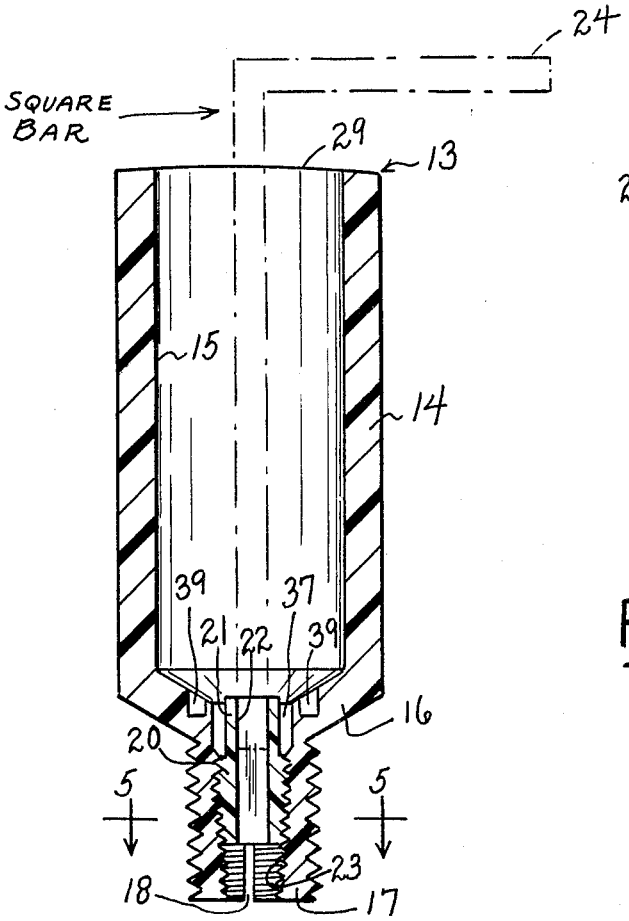
FIG. 4
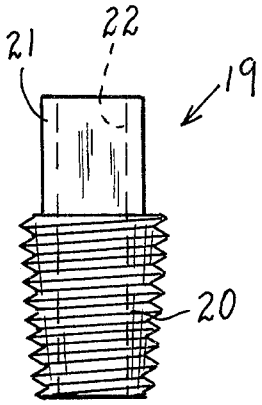
FIG. 6
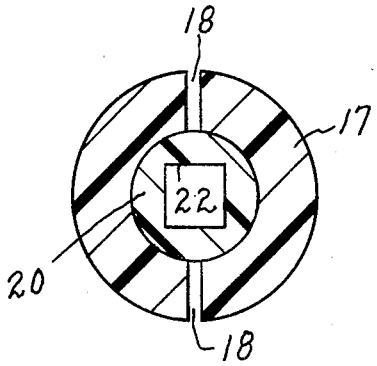
FIG. 5
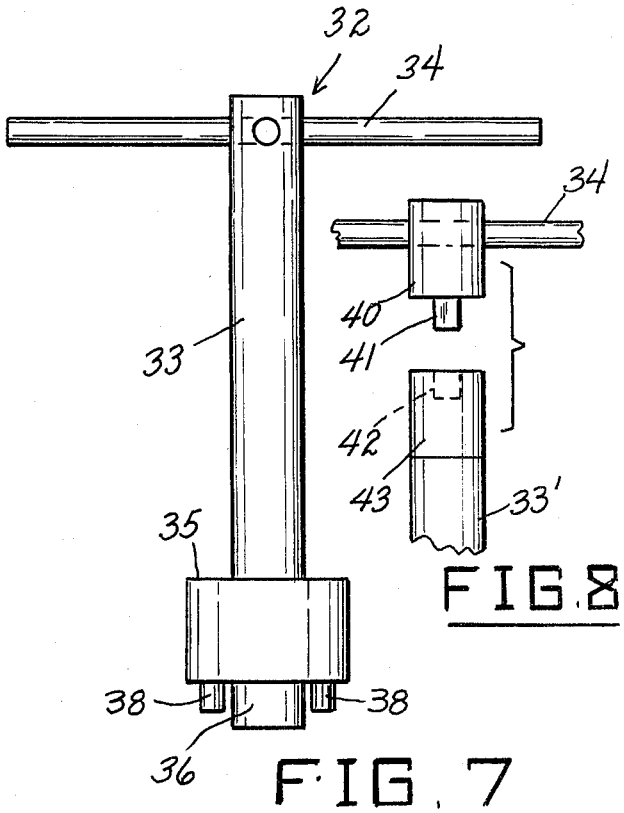
FIG. 8
FIG. 7

BOWLING BALL INCLUDING REMOVABLE FINGER GRIP INSERT

FIELD OF THE INVENTION

This invention relates to improvements in bowling balls, and more particularly to a thumb or finger grip insert removably mountable in a bowling ball to adapt it for use by an individual bowler.

BACKGROUND OF THE INVENTION

It is quite well known in the art to provide inserts in bowling ball finger gripping holes. Such inserts are employed mainly for adjusting the effective diameter of the finger gripping holes. It is important to provide the proper finger gripping hole diameter since this contributes greatly to accurate control of the ball. Also, the thumb and fingers should move smoothly in and out of their respective holes, and there should be no excess frictional drag on the thumb and fingers as they leave said holes.

Where inserts are not employed, it has been necessary for bowling alleys to provide a large supply of bowling balls with different hole sizes to accommodate the fingers and thumbs of the various patrons. Individuals who bowl frequently usually buy their own bowling balls and have the holes drilled to conform to their finger sizes. However, where an individual has done this, changes may occur in the finger sizes of the individual either as a result of growth or for other physical reasons. Therefore there is a need for providing changeable inserts as a means for conveniently adjusting the sizes of the gripping holes in bowling balls. With the inserts employed in the prior art, relatively complex and expensive means for fastening the inserts in the bowling balls and relatively complicated hole configurations are required for receiving said inserts. Therefore there is also a need for simplifying the fastening means and the required hole configurations.

A preliminary search of the patented prior art revealed the following U.S. patents, which appear to show the present state of the art:

Bendelari, U.S. Pat. No. 1,026,069
Darby, U.S. Pat. No. 2,210,528
Keith, U.S. Pat. No. 2,372,959
Seurynck, U.S. Pat. No. 2,435,327
Seurynck, U.S. Pat. No. 2,436,976
Keith, U.S. Pat. No. 2,872,367
Insetta, U.S. Pat. No. 3,001,793
Bunk et al, U.S. Pat. No. 3,012,783
Jarus, U.S. Pat. No. 3,102,725
Bednash, U.S. Pat. No. 3,129,002
Blood, U.S. Pat. No. 3,204,960
Mason, U.S. Pat. No. 3,239,223
Gerlach, U.S. Pat. No. 3,393,910
Ginder, U.S. Pat. No. 3,416,796

SUMMARY OF THE INVENTION

Accordingly, a main object of the invention is to provide novel and improved means for overcoming the deficiencies and shortcomings of the bowling ball inserts previously employed.

A further object of the invention is to provide a novel and improved bowling ball hole insert which is easy to install, which can be readily changed, which requires a very simple bowling ball hole configuration, which provides a desired finger contact surface finish, and which enables a bowler to use a bowling ball with improved accuracy and comfort.

A still further object of the invention is to provide an improved bowling ball hole insert for the thumb hole or finger holes of a bowling ball which requires a relatively small amount of modification of the original thumb or finger holes of the ball, which can be installed or removed by means of relatively simple tools, which can be quickly and securely locked in operative position in the ball, and which can be easily interchanged with a substitute insert when required.

A still further object of the invention is to provide an improved bowling ball finger hole insert which provides a properly textured or smooth thumb and finger contact surface, with bores of correct dimensions for the thumb and fingers of the user, and which provides optimum control of the ball.

A still further object of the invention is to provide an improved bowling ball thumb or finger hole insert which has a substantially cylindrical shape and has a resilient bottom hollow expansible stud threadedly engageable in the bottom of a hole in a bowling ball and which is expanded by a tapered screw member threadedly engaged in the stud, whereby to lock the insert in the bowling ball.

BRIEF DESCRIPTION OF THE DRAWINGS

Further objects and advantages of the invention will become apparent from the following description and claims, and from the accompanying drawings, wherein:

FIG. 4 is an enlarged vertical cross-sectional view taken substantially on line 4—4 of FIG. 3.

FIG. 5 is an enlarged horizontal cross-sectional view taken substantially on line 5—5 of FIG. 4.

FIG. 6 is an enlarged elevational view of a tapered locking screw employed in the thumb hole insert of FIGS. 1 to 5.

FIG. 7 is an enlarged elevational view of a spanner wrench tool which may be employed in installing or removing the thumb hole insert of FIGS. 1 to 5.

FIG. 8 is a fragmentary elevational view of separated portions of a modified spanner wrench tool which may be employed instead of the tool shown in FIG. 7.

DESCRIPTION OF A PREFERRED EMBODIMENT

Figure 1:
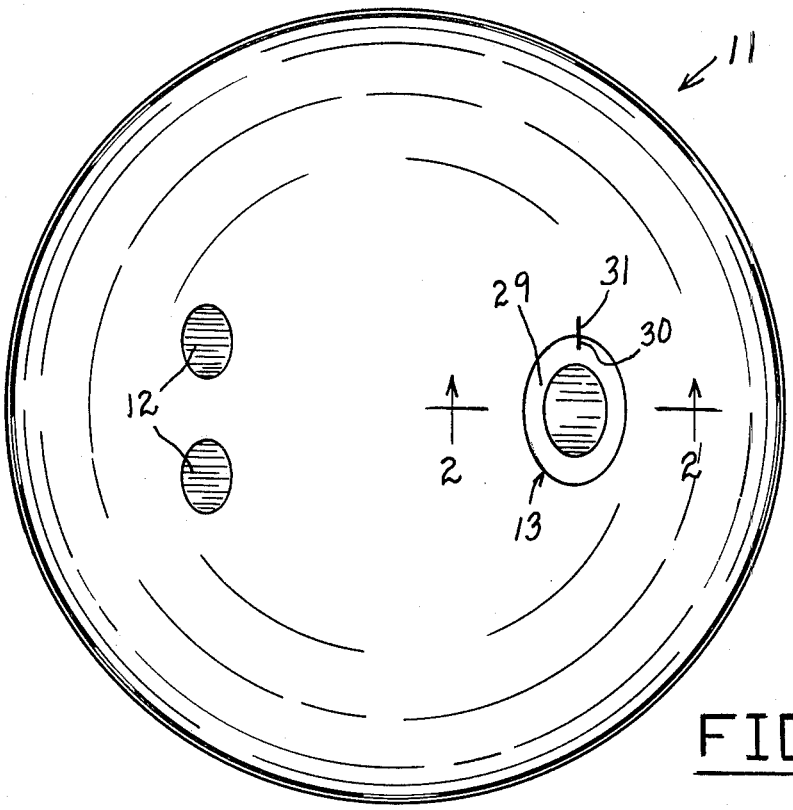
FIG. 1 is a top plan view of a bowling ball provided with an improved thumb hole insert constructed in accordance with the present invention.
Figure 2:
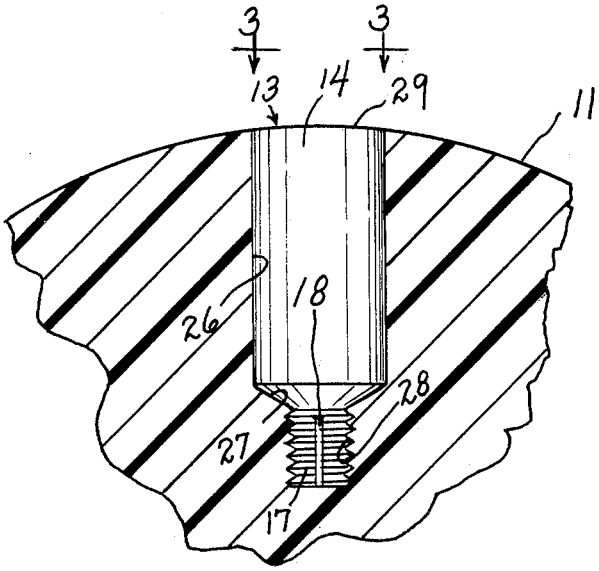
FIG. 2 is an enlarged fragmentary vertical cross-sectional view taken substantially on line 2—2 of FIG. 1.
Figure 3:
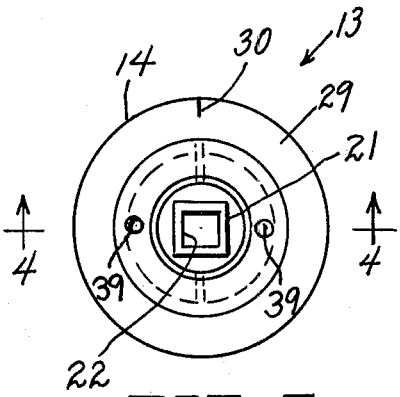
FIG. 3 is an enlarged horizontal plan view taken substantially on line 3—3 of FIG. 2.

Referring to the drawings, 11 designates a substantially conventional bowling ball which is normally provided with a thumb gripping hole and a pair of spaced finger holes. In the particular embodiment herein illustrated and described it will be assumed that an insert is employed only for the thumb hole, although it should be understood that similar inserts may also be employed in the finger holes. Thus, in FIG. 1 the original finger holes are shown at 12, 12 and an improved thumb hole insert according to the present invention is shown at 13.

Referring to FIGS. 2 to 5, it will be seen that the insert 13 comprises a generally cylindrical main body 14 with a smooth or suitably textured inside axial bore 15, and having a downwardly tapering, substantially frustoconical bottom wall 16 which terminates in a depending internally and externally threaded hollow axial stud 17. The stud 17 has diametrically opposite longitudinal slots 18, 18 extending for the major portion of the length of the stud to make the stud substantially resilient, namely, to allow flexing of the opposite halves of the stud.

The main body 14 may be made of any suitable material of a plastic nature, for example, Delron, which has suitable strength and which can be given a relatively smooth fine finish. The inside bore 15 may be lightly sanded to provide a desired degree of texture and to provide a desired slight amount of drag on the user's thumb as it leaves the thumb grip hole.

Designated at 19 is a plastic hollow locking screw member having an enlarged, downwardly tapering, externally threaded lower body portion 20 and an upstanding square top portion 21, said screw member being formed with the square axial bore 22 extending for its full length. The externally threaded enlarged lower portion 20 is threadedly engageable with the internal threads 23 of stud 17, and provides wedging action when the screw member 19 is rotated in a direction to move the screw member downwardly in the stud, namely, forcing the flexible opposite halves of the stud apart. Rotation of the screw member 19 may be accomplished by means of a suitable driving tool, such as an L-shaped square bar 24, shown in broken line view in FIG. 4, whose shank portion is conformably engageable in the square axial bore 22 of screw member 19, as shown.

For employing the thumb hole insert 13, the original thumb hole of the bowling ball 11 must be modified to provide a main cylindrical bore 26 of suitable size to closely receive insert portion 14, with a frusto-conical bottom 27 shaped to closely receive wall 16, and with a reduced internally threaded bottom hole 28 to threadedly receive the stud 17. Where the bore 26 is substantially radial, the top end of the insert, shown at 29, is merely spherically rounded off to be flush with the adjacent surface of the bowling ball. If the bore 26 is non-radial, the rounded-off top end 29 may be provided with an index mark 30 which is registrable with a cooperating index mark 31 on the bowling ball to assure an accurately spherically flush rotated position of the insert when it is installed.

Installation of the insert may be accomplished by means of a suitable spanner wrench tool such as that shown at 32 in FIG. 7. Said tool 32 comprises a shank 33 having a gripping handle bar 34 rigidly secured to its top end and having a cylindrical collar block 35 secured on its bottom end portion and being spaced above the bottom end of shank 33 to define a bottom pilot stud 36 receivable in a pilot recess 37 in the lower portion of frusto-conical wall 16. Collar block 35 is provided with opposite depending spanner lugs or pins 38, 38 receivable in spanner wrench holes 39, 39 provided in wall 16 outwardly adjacent pilot recess 37.

To install the insert 13, the main body 14 thereof, without the screw member 19, is inserted in the bowling ball bore 26 and stud 17 is threadedly engaged with the threaded hole 28, the tool 32 being then lockingly interengaged with the insert main body for rotating same, namely, with pilot member 36 received in recess 37 and with pins 38, 38 respectively engaged in holes 39, 39. When the main body 14 has been rotated to substantially its fully received position in bore 26, with its top end spherically flush with the spherical adjacent bowling ball surface, the tool 32 is withdrawn. The screw member 19 is then inserted and the externally threaded enlarged lower end portion 20 thereof is threadedly engaged with the internal threads 23 of stud 17, employing the L-shaped square bar 24 engaged in square bore 24 to rotate the screw member 19 until the opposite flexible halves of stud 17 have been wedgingly expanded to a secure locking condition.

FIG. 8 shows a modification of the spanner wrench, wherein the handle bar 34 is secured at its midportion to a conventional drive ratchet assembly 40. Ratchet assembly 40 has a depending square drive lug 41 drivingly engageable in a square hole 42 in a socket member 43 secured on the top end of the spanner wrench shank 33'.

When the insert 13 is to be removed, for example, for replacement by another insert of different hole size, the screw plug 19 is first loosened by means of a tool 24 and is removed. The main body of the insert can then be loosened and removed by means of a spanner wrench tool of the type shown in FIG. 7 or FIG. 8.

The insert of the present invention, being made completely of plastic material and containing no metal, is completely legal in bowling. Since interchange of inserts can be performed very rapidly, the bowler is not limited to an uncomfortable fit, and can change inserts as required for maintaining a good release at all times. Since the insert material employed causes little friction, it helps to minimize blistering and tearing of the skin. The insert also eliminates any need for resorting to special techniques previously needed to overcome thumb and finger difficulties and extends the life of bowling balls by preventing chipping at the finger and thumb holes that would otherwise require the balls to be discarded.

The preferred material, Delron, is very strong, being similar to Nylon. If the inserts become damaged, however, they can be readily replaced without requiring discarding of the bowling ball.

The finger hole or thumb hole inserts can be quickly replaced whenever minor dimensional changes of hole sizes are desired. This enables a player to obtain a comfortable grip at all times and assists in obtaining maximum scoring accuracy, as well as improving the player's confidence that the ball will be released without hanging or dropping.

While the screw plug 19 has been shown as having a non-circular bore, such as square bore 22 engageable by a square-bore driving tool 24, said plug may have any desired driving configuration, for example, may be provided merely with a screw driver slot for engagement by a conventional screw driver, or a nut head engageable by a suitable socket wrench.

While a specific embodiment of an improved bowling ball insert has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment.

What is claimed is:

1. A bowling ball comprising a solid spherical body having a substantially cylindrical finger bore extending therein from the spherical surface of said body, the bottom of said bore having a central tapped hole, a substantially cylindrical hollow insert closely fitting in said finger bore and having a hollow expansible reduced axial bottom stud threadedly engaged in said central tapped hole, and a screw plug member having an externally threaded downwardly tapering lower portion threadedly engaging in said bottom stud so as to expand said stud responsive to rotation of the screw plug member and removably lock the insert in said finger bore.

2. The bowling ball of claim 1, and wherein said insert has a substantially frusto-conical, downwardly convergent, bottom wall, and wherein the bottom of said finger bore is formed with a frusto-conical seat for said bottom wall.

3. The bowling ball of claim 2, and wherein said insert bottom wall is formed with a plurality of spaced holes to receive the driving pins of a spanner wrench.

4. The bowling ball of claim 1, and wherein said hollow bottom stud is slotted to render opposite portions thereof flexible relative to each other.

5. The bowling ball of claim 1, and wherein said hollow bottom stud is formed with a plurality of longitudinal slots to define outwardly flexible portions.

6. The bowling ball of claim 1, and wherein the top portion of said screw plug member is formed with tool-engaging means.

7. The bowling ball of claim 1, and wherein said screw plug member is formed with a non-circular bore for engagement with a correspondingly-shaped driving tool.

8. The bowling ball of claim 1, and wherein said bottom stud is provided with internal threads which threadedly receive the downwardly tapering lower portion of the screw plug member.

9. The bowling ball of claim 1, and wherein the insert is provided with an annular bottom wall formed internally with an annular recess defining a pilot hole, and formed with a plurality of spaced spanner wrench holes outwardly adjacent said annular recess.

10. The bowling ball of claim 9, and wherein said bottom wall is substantially frust-conical and tapers downwardly, and wherein said bowling ball finger bore is conformably shaped to interfit with said bottom wall.

* * * * *